US010392805B2

(12) United States Patent
Mishler

(10) Patent No.: US 10,392,805 B2
(45) Date of Patent: Aug. 27, 2019

(54) MULTI-ROLL GRANULE APPLICATION

(71) Applicant: Building Materials Investment Corporation, Dallas, TX (US)

(72) Inventor: Patrick Mishler, Dundalk, MD (US)

(73) Assignee: Building Materials Investment Corporation, Dallas, TX (US)

( * ) Notice: Subject to any disclaimer, the term of this patent is extended or adjusted under 35 U.S.C. 154(b) by 345 days.

(21) Appl. No.: 14/482,895

(22) Filed: Sep. 10, 2014

(65) Prior Publication Data

US 2015/0072074 A1 Mar. 12, 2015

Related U.S. Application Data

(60) Provisional application No. 61/876,386, filed on Sep. 11, 2013.

(51) Int. Cl.

| | |
|---|---|
| ***E04D 1/20*** | (2006.01) |
| ***B05C 19/04*** | (2006.01) |
| ***B05C 19/00*** | (2006.01) |
| ***B05D 5/06*** | (2006.01) |
| ***B05C 9/06*** | (2006.01) |
| ***B05C 19/06*** | (2006.01) |
| ***E04D 1/00*** | (2006.01) |
| ***B05D 5/02*** | (2006.01) |
| ***B05D 1/30*** | (2006.01) |

(52) U.S. Cl.

CPC ..... *E04D 1/20* (2013.01); *B05C 9/06* (2013.01); *B05C 19/008* (2013.01); *B05C 19/04* (2013.01); *B05C 19/06* (2013.01); *B05D 5/06* (2013.01); *B05D 1/30* (2013.01); *B05D 5/02* (2013.01); *E04D 2001/005* (2013.01)

(58) Field of Classification Search

CPC ..... B05C 19/008; B05C 19/04; B05C 19/06
See application file for complete search history.

(56) References Cited

U.S. PATENT DOCUMENTS

| | | | | |
|---|---|---|---|---|
| 5,795,389 | A * | 8/1998 | Koschitzky | B05C 19/06 118/308 |
| 5,795,622 | A * | 8/1998 | Belt | B05C 19/04 427/186 |
| 5,858,095 | A * | 1/1999 | White | B05C 19/04 118/308 |
| 5,997,644 | A | 12/1999 | Zickell | |
| 6,095,082 | A | 8/2000 | Belt et al. | |
| 6,610,147 | B2 | 8/2003 | Aschenbeck | |
| 7,163,716 | B2 | 1/2007 | Aschenbeck | |
| 7,638,164 | B2 | 12/2009 | Aschenbeck | |
| 8,316,608 | B2 | 11/2012 | Binkley et al. | |

* cited by examiner

*Primary Examiner* — Dah-Wei D. Yuan
*Assistant Examiner* — Stephen A Kitt
(74) *Attorney, Agent, or Firm* — Womble Bond Dickinson (US) LLP

(57) ABSTRACT

A method and apparatus for applying or dropping granules onto the asphalt coated surface of a moving sheet in shingle manufacturing is disclosed. The method includes sharing each drop between two or more blend rolls with a subsequent blend roll or rolls applying a partial drop directly on top of partial drops already applied by a first blend roll or rolls. High production speeds can be accommodated since each roll can be operated at slower rotation rates and with slower acceleration and deceleration requirements than would be required if the full granule drop were applied during the same time interval with a single blend roll.

4 Claims, 2 Drawing Sheets

MULTI-ROLL GRANULE APPLICATION

REFERENCE TO RELATED APPLICATION

Priority is hereby claimed to the filing date of U.S. provisional patent application 61/876,386 filed on Sep. 11, 2013 and entitled Multi-Roll Granule Application.

TECHNICAL FIELD

This disclosure relates generally to shingle manufacturing and more specifically to the application of protective granules onto a moving asphalt coated sheet or web during shingle manufacturing.

BACKGROUND

Asphalt-based roofing materials, such as roofing shingles, roll roofing, and commercial roofing, have long been installed on the roofs of buildings to provide protection from the elements and to give the roof an aesthetically pleasing appearance. Typically, asphalt-based roofing material is constructed of a substrate such as a glass fiber mat or an organic felt mat, an asphalt coating on the substrate to provide a water barrier, and a surface layer of granules embedded in the asphalt coating. The granules help protect the asphalt from deterioration due to exposure to UV and IR radiation from the sun and direct exposure to the elements.

A common method of manufacturing asphalt-based shingles is to advance an endless sheet of the substrate material through a coater, which coats the sheet with heated liquid asphalt forming a hot tacky asphalt coated sheet. The asphalt coated sheet is typically then passed beneath one or more granule applicators, which dispense and apply protective and decorative surface granules onto at least selected portions of the moving asphalt coated sheet. A granule applicator may be as simple as a direct feed nozzle fed by an open hopper that is filled with granules or as complex as a servo controllable rotating fluted rollers and gate assemblies at the mouth of a granule hopper. The result can be an endless sheet of granule coated shingle stock, which can later be cut to size to form individual shingles, cut and rolled to form a rolled shingle, or otherwise processed into final shingle products.

In some shingle manufacturing processes, there is a need to deliver granules at intermittently timed intervals such that granules are applied to the asphalt coated sheet in patches that are spaced apart from each other and that are usually rectangular. For instance, patches of dark and light granules may be separated by patches of blended granules to form a decorative shingle. In such cases, several mechanisms have been used in the past to start and stop the delivery of granules in a controlled manner to produce the spaced patches of granules. Such mechanisms include, for instance, articulating gates at the outlet of a granule hopper and servo controlled fluted roll and gate assemblies at the outlet of a granule hopper. Fluted roll and gate assemblies may include one or more fluted rolls disposed along the outlet of a granule hopper. The fluted rolls can be rotated by server motors that, in turn, are controlled by a computer based controller. The gate assemblies also may be controlled by the controller. When a fluted roll is rotated and stopped by its servo motor, a metered charge of granules is drawn from the granule hopper and dropped onto the moving asphalt coated sheet below. In this way, intermittent patches of granules can be created on the asphalt coated sheet.

Prior systems and methods of depositing granules onto an asphalt coated sheet in shingle manufacturing have proven acceptable at lower production speeds (i.e. the speed of the asphalt coated sheet) but begin to exhibit problems at higher production speeds. For instance, as the speed of production increases, the edges and patterns of spaced granule patches on the asphalt become less and less defined. Eventually, the deposited patches of granules are so indistinct and distorted as to be unacceptable in appearance, coverage, and protection. Trailing edges in particular of a deposited patch of granules become more and more smeared out as the speed of production is increased and dispensed charges of granules exhibit unacceptable trailing patterns. As a result, granule delivery systems and methods typically used in the past have been practically limited to production speeds below about 800 feet per minute (FPM), even though other areas of shingle production are capable of moving much faster.

The above problem involves the decreasing ability to control precisely the rotation of fluted granule dispensing rolls, sometimes referred to as blend rolls, at higher production speeds. The volume of granules applied in a given application or "drop" typically is controlled by varying the gate position relative to the fluted roll and by varying the speed and duration of rotation of the fluted roll. Both may be controlled or varied as a function of production speed. To accomplish this, the servo and gate parameters are manipulated by the computer-based controller to control the amount of granules dropped in a given period of time. This, in turn, determines the appearance of patches of granules on the sheet. As production speed increases, the acceleration, duration, and deceleration of the fluted roll must be increased accordingly as well as gate position and other parameters because the same amount of granules must be dropped in a shorter interval of time.

The ability to control these parameters degrades as production speeds increase because of the need to apply more granules faster. This is accomplished by opening up the gate of the granule hopper to allow more granules to flow to the fluted roll and increasing the acceleration, speed, duration, and deceleration of the fluted roll. As production speeds increase more, the ability to control these parameters in such a way that acceptably distinct patterns of granules are deposited on the moving asphalt coated sheet below is lost. Plus, there is an inherent maximum speed at which servo motors can accelerate, rotate, and decelerate the rolls, which also limits production speed. Finally, the rate at which the granules fall is dictated by gravity and is substantially constant regardless of the rotation rate of a dispensing roll.

There is a need for a granule delivery system and method for use in shingle manufacturing that is capable of delivering a charge of granules at intermittently timed intervals onto a moving asphalt coated sheet with precision, definition, and controllability at higher manufacturing speeds of over 800 FPM and even over 1000 FPM. It is to the provision of such an apparatus and method that the present invention is primarily directed.

SUMMARY

The entire content of U.S. provisional patent application No. 61/876,386, to which priority is claimed above, is hereby incorporated by reference in its entirety.

Briefly described, a method and apparatus for applying granules to a moving asphalt coated sheet is disclosed wherein two or more granule applicators, which may be fluted roll and gate assemblies, are spaced apart by a set distance and share the application of granule patches to the moving asphalt sheet. Each roll and gate assembly drops a partial charge of granules and the assemblies are timed to drop their partial charges at the same location on the moving asphalt coated sheet below, one application following another. As a result, a granule patch is created that is distinct even at high production speeds because each roll and gate assembly can operate at a slower speed and thus can be controlled more accurately. These and other features, aspects, and advantages of the method and apparatus disclosed herein will be better understood upon review of the detailed description set forth below taken in conjunction with the accompanying drawing figures, which are briefly described as follows.

DETAILED DESCRIPTION

Figure 1:
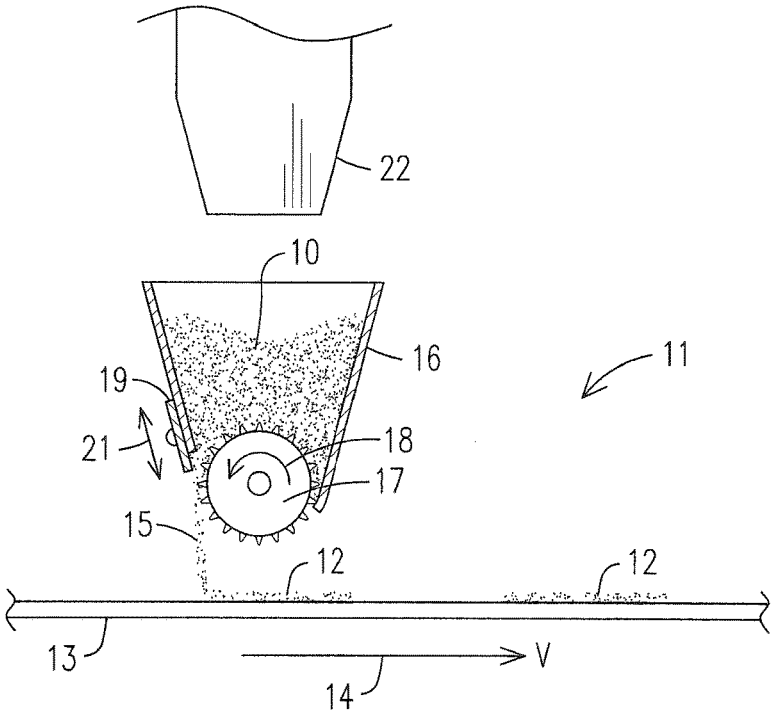
FIG. 1 is a simplified schematic of a typical fluted roll and gate assembly for applying granules to a moving asphalt coated sheet below.

Reference will now be made to the annexed drawing figures, wherein like reference numerals indicate like parts throughout the views. FIG. 1 illustrates in greatly simplified form a typical roll and gate type granule application system for applying granules to a moving asphalt coated sheet in the production of asphalt shingles. The application system 11 resides over the asphalt coated sheet 13 being moved in a machine direction 14 at a velocity of V feet per minute (fpm). The system 11 includes a hopper 16 that contains a supply of granules 10 provided from a granule bin 22. The hopper 16 has an elongated mouth at its bottom end along which is disposed a fluted roll 17.

The fluted roll 17 has an outer surface formed with longitudinally extending flutes or other features and can be rotated or indexed or jogged in direction 18 by an associated servo motor (not shown). The servo motor can be controlled by a software application residing in and running on a computer or dedicated controller to start, rotate, and stop the fluted roll according to a predetermined timing schedule. A gate 19 is mounted for controlled movement in directions 21 so that the distance between the lower edge of the gate 19 and the fluted roll 17 can be varied as needed to increase or decrease the space between the bottom edge of the gate 19 and the surface of the fluted roll 17. This, in turn, increases or decreases respectively the volume of granules that are dropped per rotation of the fluted roll 17.

It will be understood by the skilled artisan that the gate 19 might be located on the opposite side of the hopper 16 and the fluted roll 17 in that event might rotate in the opposite direction from direction 18. These two variants are known in the art, with one dropping granules generally in the direction of movement of the asphalt coated sheet 13 and the other dropping granules generally in a direction opposite to the movement of the asphalt coated sheet 13. The present invention is applicable to either of these variants. The invention is described herein within the context of the variant shown in FIG. 2.

During production, the asphalt coated sheet 13 is moved by an appropriate conveyor in direction 14 at a predetermined velocity V. Periodically, the fluted roll 17 is jogged (i.e. rotated through a predetermined angle) by its servo motor at a predetermined rate and for a predetermined duration. This causes granules to be dragged out of the hopper 16 by the fluted surface of the roll 17. When the granules are free of the hopper, they fall in a curtain 15 onto the moving asphalt coated sheet 13. The position of the gate 19 as well as the acceleration, duration, and deceleration of the rotation of fluted roll 17 determines the volume of granules that are dropped onto and applied to the sheet. The timing of the intermittent jogging of the fluted roll 17 causes granules to be deposited onto the sheet in spaced apart generally rectangular patches 12. The spaces between the patches may be filled in later with a blend of granules and/or other patches to result in a decorative granule pattern on a finished shingle. As discussed above, at higher production speeds or velocities V above about 800 ft/min, the ability to control precisely the rotation of the fluted roll 17 and to control precisely the position of the gate 19 degrades significantly. As a result, the ability to apply well-defined predictable patches 12 of granules also deteriorates. Plus, when a higher production speed requires rotation of the fluted roll beyond its maximum rotation rate, the production speed cannot be increased further. As a result, a single roll application system 11 such as that shown in FIG. 1 becomes unacceptable for creating acceptable patches of granules on the asphalt coated sheet 13 at higher production speeds.

Figure 2:
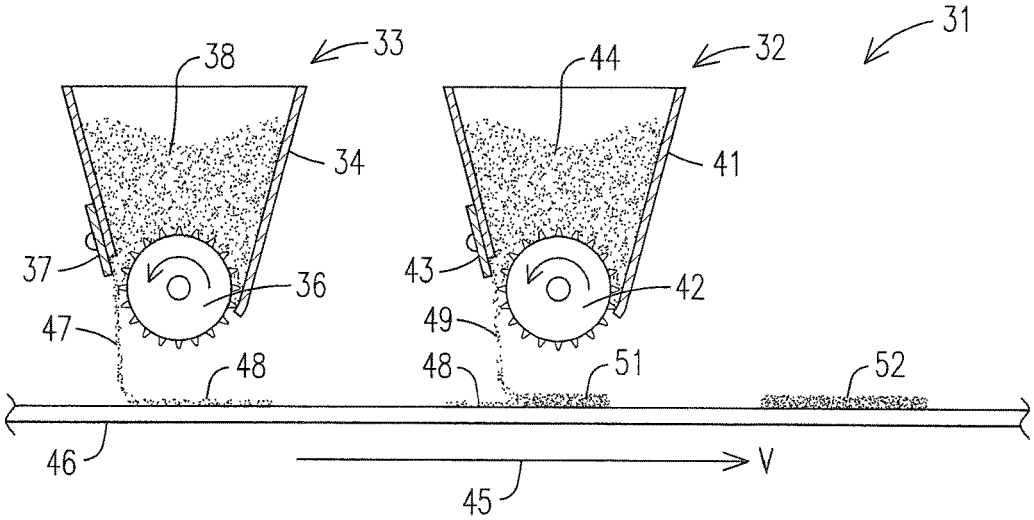
FIG. 2 shows the sharing of a granule drop by two spaced apart roll and gate assemblies according to an embodiment of the present disclosure.

FIG. 2 illustrates a granule application system 31 according to one embodiment of the present invention for applying well-defined spaced apart patches of granules to a moving asphalt coated sheet at high production speeds. The system 31 comprises a first granule applicator 33 and a second granule applicator 32 located downstream of the first. Each of the applicators 33 and 32 may be similar to that of FIG. 1. More specifically, first granule applicator 33 includes a hopper 34, a servo-controlled rotatable fluted roll 36, and a related gate 37 as described above. Likewise, second granule applicator 32 includes a granule hopper 41, a servo-controlled rotatable fluted roll 42, and a gate 43. The servo motors that drive and index the fluted rolls 36 and 42 as well as the positions of gates 37 and 43 are controllable by a computer-based machine controller (not shown) to supply a desired amount of granules in a specified length of time onto the moving sheet below.

According to the invention, the first applicator 33 and second applicator 32 are coordinated and synchronized with each other such that the applicators share the task of depositing each patch of granules onto the moving sheet. The first applicator 33 is controlled to apply a first but only partial charge of granules to the area of the granule patch and the second applicator is timed and controlled to apply a second partial charge on top of the first partial charge applied by the first applicator 33. Each partial charge may, for example, comprise half of the amount of granules needed for the completed granule patch. The first applicator 33 drops its partial charge in a curtain or curtains of granules 47 to form a thinly distributed patch or patches 48 of granules on the moving sheet. Then, the second applicator 32 is timed to drop its partial charge in a curtain or curtains of granules 49 on top of the thinly distributed patch 48 created by the first applicator. This creates a second partial patch 51 of granules on top of the first partial patch 48 and the granules of the second partial patch fill in the spaces between granules of the first partial patch to create a final granule patch 52 comprised of the correct amount of granules. In other words, the first partial patch has a granule density less that the final or target granule density as does the second. However, the sum of the two granule densities is substantially equal to the desired final density of the patch.

One important advantage of the system and method of FIG. 2 is that each applicator applies only half (or some other fraction) of granules needed for the finished patch. As a consequence, the acceleration, duration, and deceleration of the indexed rotation of each roll can be slower and the gate opening can be smaller than would be required to deposit the entire amount of granules in one drop as in FIG. 1. This allows finer control of the shape and characteristics of the granule patches even at production speeds where single applicator drops fail or where the rotation rates of the blend rolls are maxed out. In fact, as production speed increases further, more than two applicators may be coordinated to share each granule drop to accommodate the higher production speeds while producing well defined granule patches.

Figure 3:
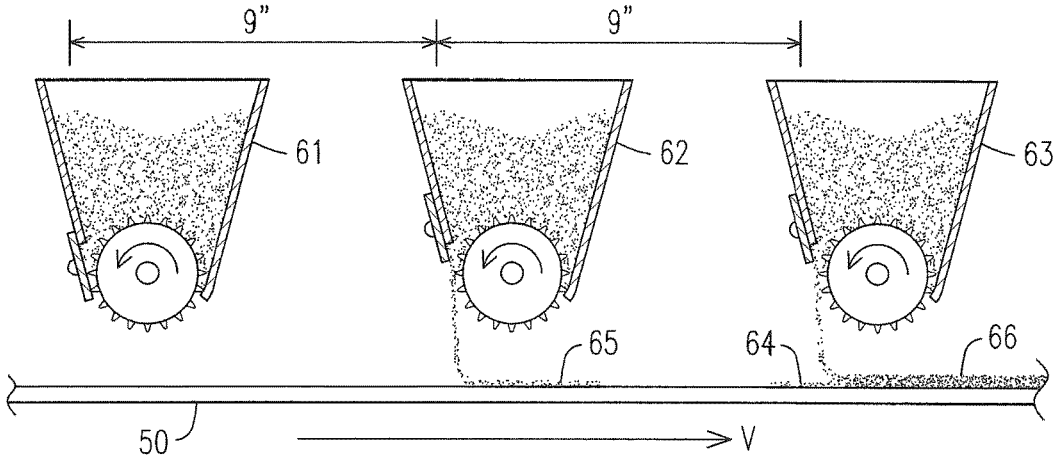
FIG. 3 illustrates in schematic form yet another embodiment of the invention wherein two roll and gate assemblies alternate application of a partial charge of granules and a third roll and gate assembly applies the second partial charge of granules atop each partial charge.

FIG. 3 illustrates a further embodiment wherein two applicators 61 and 62 share the job of applying the first partial patch 64 and 65 to the moving asphalt coated sheet 50 and a single applicator 63 applies the second partial patch 66 atop the previously applied first partial patches to form the competed patches of granules. More specifically in this embodiment, the first partial patch 64 is applied by the first applicator 61 and the next partial patch 65 is applied by the second applicator 62. It will thus be seen that the applicators 61 and 62 alternate the application of the initial partial patches of granules to the moving asphalt coated sheet below. A third applicator 63 then applies a final partial patch 66 atop each of the initial partial patches to complete the final patches of granules. Of course, two or more applicators may be configured to alternate the task of applying the final partial patch 66 in the same way that the applicators 61 and 62 alternate the application of the initial partial patch.

The three applicators shown in FIG. 3 and their function is not limiting. For example, the first two applicators along the processing path may each be controlled to apply a partial patch of granules having a granule density substantially equal to one-quarter of the target final density. Thus, two applicators may share the application of the first partial patch rather than alternating this application. The same goes for the applicators that apply the final partial patches on top of the initial partial patches. All such operation schemes and others are intended to be included within the scope of the present invention. Regardless of the configuration, the sharing of granule application by two or more applicators reduces the cycling demands on these applicators and their servo motors at higher and higher line speeds. This, in turn, accommodates higher production speeds without overworking any one granule applicator, resulting in acceptably distinct granule patches at modern higher production rates. A specific example of the embodiment shown in FIG. 3 is discussed below in the Example.

EXAMPLE

Following is an example of how multiple granule applicators may be coordinated and synchronized to obtain a desired spaced granule patch pattern on a moving asphalt coated sheet.

In this example, a 60 inch repeat pattern containing 15 inch long granule patches separated by 15 inch gaps is desired to be applied to the moving asphalt coated sheet. Each repeat thus comprises a first 15 inch long granule patch, a fifteen inch long gap, a second fifteen inch long granule patch, and another 15 inch long gap. Three blend rolls are used to deposit the granule patches in this example and the blend rolls are positioned nine (9) inches apart along the machine direction. Two blend rolls share each granule drop in that one drops a partial charge of granules and another drops another partial charge directly onto the previously applied partial charge. Blend roll 1 is the upstream blend roll, blend roll 3 is the downstream blend roll, and blend roll 2 is between blend rolls 1 and 3 in this example.

With the forgoing configuration in mind, the production speed; i.e. the speed at which the asphalt coated sheet is moving, is taken or read from the master ramp. Assume for this example that the production speed is determined to be 700 feet per minute (fpm). The machine control routine scans or cycles at a frequency of once every 5 milliseconds (0.005 seconds). It is desired then to determine the number of inches of asphalt coated sheet that pass a fixed point in 0.005 seconds. We thus have 700 fpm/60 seconds per minute equals 11.666 feet per second (fps). 11.666 fps×12 inches per foot equals 140 inches per second (ips). Finally, 140 ips×0.005 seconds equals 0.7 inches for each 5 millisecond scan interval of the control program. This means that at each scan or cycle of the control routine, the asphalt coated sheet has moved 0.7 inches in the downstream direction.

The calculated inches per 5 milliseconds then gets accumulated or added up in a counter each cycle of the control routine and this accumulated length is used by the routine to decide when the fluted rolls of the granule applicators should be rotated or jogged to produce the desired granule patterns on the moving sheet below. The accumulated length in this example is incremented until it equals 60 inches (the length of the repeat pattern) and then is reset to zero for the next successive repeat.

The routine is programmed to send a command to blend roll 1 to rotate and drop its partial charge of granules during the time when the accumulated length in the counter is between 0 and 15 inches. This deposits the partial charge of granules in the area of the first granule patch. As long as the accumulated length is between 0 and 15 inches, the servo for blend roll 1 rotates blend roll 1 at the necessary speed to drop its partial charge of granules. Blend roll 2 is 9 inches downstream from blend roll 1 and deposits a partial charge of granules in the area of the second granule patch, which is located between 30 and 45 inches from the start of the repeat pattern. Thus, for this drop, the accumulated length is read from the counter and 9 inches is subtracted. The blend roll 2 servo is commanded to rotate blend roll 2 when the accumulated length less 9 inches is between 30 and 45 inches. Accordingly, a partial charge of granules is deposited by blend roll 2 between 30 inches and 45 inches from the start of the repeat pattern. Subtracting the 9 inches simulates a configuration where the two blend rolls are located at the same position so that the methodology works easily.

Blend roll 3 is used to deposit another partial charge of particles on top of the partial charges deposited by blend rolls 1 and 2 to complete the creation of the granule patches. For this step, 18 inches (the distance between the first blend roll and the third blend roll) is subtracted from the accumulated length of the counter and the servo for blend roll 3 is commanded to rotate blend roll 3 to apply its partial drop when the accumulated length less 18 inches is between 0 and 15 inches. In this way, a partial blend drop is applied by blend roll 3 directly on top of the first blend drop previously deposited by blend roll 1. The first granule patch is thus completed. The third blend roll is also commanded to be rotated when the accumulated length in the counter, less 18 inches, is between 30 and 45 inches. In this way, the third blend roll deposits another partial charge of particles directly on top of the patch previously deposited by blend roll 2 to complete the second granule patch. At the end of the 60 inch repeat, the accumulation counter is reset to zero, and the process repeats to create the next successive pattern of granule patches.

Various parameters should be adjusted as the production speed is increased. More specifically, at 100 fpm intervals of production speed, the acceleration, deceleration, and speed of the blend rolls are adjusted linearly. This may be done visually by running the product, observing the granule patterns, and making the appropriate adjustments in 100 fpm increments. If the drops don't have enough density then the blend roll rotation rate may be increased to allow more granules to flow during an application. The acceleration and deceleration of the blend rolls is adjusted to provide the desired leading and trailing edge contours for each drop. If acceleration is to fast then the granules are slipped under. If the acceleration is too slow then the pattern of granules looks smaller. The last adjustment is to the pre-triggers where a few inches can be added or subtracted from the length of the drop to provide the best looking drop possible.

By using two blend rolls and servo's to share the task of creating a single granule patch, the density of the final granule patch is the same as if a full drop had been applied with one roll. However, and particularly at the higher production speeds, the speed at which the individual servos and their blend rolls must be rotated is reduced significantly since a smaller amount of granules need to be dropped in the same time interval. This allows the velocity at the surface of the rolls to be less, which improves the amount of slip that would normally occur. It also provides the capability to raise production speeds higher because the speed of each blend roll is not maxed out by a requirement for a short duration drop of a full charge of granules.

The invention has been described herein in terms of preferred embodiments and methodologies considered by the inventor to represent the best mode of carrying out the invention. However, a wide range of additions, deletions, and modifications might well be made by one of skill in the art within the scope of the invention. For instance, a drop may be shared by more than two blend rolls to accommodate higher production speeds or to improve the appearance of each granule patch. Patterns other than those in the given example may be created through similar methodology. These and other changes may be made to the disclosed exemplary embodiment without departing from the spirit and scope of the invention as set forth in the claims.

What is claimed is:

1. A multi-roll granule application system for applying roofing granules in spaced apart generally rectangular patches on a moving asphalt coated sheet of material in the production of roofing shingles with the granules of each patch having a final granule density, the system comprising:

a conveyor assembly adapted to move the asphalt coated sheet of material in a downstream direction at a predetermined rate;

a first fluted roll granule applicator disposed over the sheet of material with the fluted roll of the first granule applicator extending transverse to the downstream direction and being controllable to drop a first predetermined amount of granules at intermittently timed intervals such that the granules fall onto the moving asphalt coated sheet of material below to form on the asphalt coated sheet spaced apart generally rectangular granule patches each having a granule density less than the final granule density;

the rate at which the granules of the first predetermined amount of granules fall upon being dropped by the first fluted roll granule applicator being dictated by gravity;

a second fluted roll granule applicator disposed over the asphalt coated sheet of material downstream from the first fluted roll granule applicator with the fluted roll of the second granule applicator extending transverse to the downstream direction and parallel to the fluted roll of the first granule applicator, the second granule applicator being controllable to drop a second predetermined amount of granules at intermittently timed intervals such that the granules fall onto the moving asphalt coated sheet of material below on top of the granule patches dropped by the first fluted roll granule applicator to form on the asphalt coated sheet spaced apart generally rectangular granule patches each having the final granule density;

the rate at which the granules of the second predetermined amount of granules fall upon being dropped by the second fluted roll granule applicator being dictated by gravity;

the spaced apart generally rectangular patches having the final granule density being more distinctly shaped on the asphalted coated sheet of material than granule patches having the final density dropped by a single granule applicator.

2. A multi-roll granule application system as claimed in claim 1 wherein the first fluted roll granule applicator comprises a blend roll.

3. A multi-roll granule application system as claimed in claim 2 wherein the second fluted roll granule applicator comprises a blend roll.

4. A multi-roll granule application system as claimed in claim 1 further comprising a third fluted roll granule applicator disposed over the asphalt coated sheet of material and located between the first fluted roll granule applicator and the second fluted roll granule applicator, the first fluted roll granule applicator and the third fluted roll granule applicator being controlled to alternate the drops of the first predetermined amount of granules to form the spaced apart generally rectangular granule patches having a granule density less than the final granule density with the second granule applicator being controlled to drop the second predetermined amount of granules on top of the granule patches formed by the first granule applicator and the third granule applicator to form on the asphalt coated sheet spaced apart generally rectangular granule patches each having the final granule density.

* * * * *